US005148713A

United States Patent [19]

Kimura et al.

[11] Patent Number: 5,148,713

[45] Date of Patent: Sep. 22, 1992

[54] STARTER SYSTEM FOR AN INTERNAL COMBUSTION ENGINE

[75] Inventors: Eiichi Kimura, Kiryu; Shinichi Nagashima; Hitoshi Ono, both of Ashikaga; Koji Nara, Maebashi, all of Japan

[73] Assignee: Mitsuba Electric Mfg. Co., Ltd., Gumma, Japan

[21] Appl. No.: 703,546

[22] Filed: May 21, 1991

[30] Foreign Application Priority Data

May 22, 1990 [JP] Japan ..... 2-053171[U]
May 22, 1990 [JP] Japan ..... 2-053172[U]

[51] Int. Cl.[5] ..... F02N 15/06

[52] U.S. Cl. ..... 74/6; 74/7 A; 74/7 E

[58] Field of Search ..... 74/6, 7 R, 7 A, 7 E; 29/401.1

[56] References Cited

U.S. PATENT DOCUMENTS 2,053,634 9/1936 Roes ..... 74/6 X
2,492,550 12/1949 Bolles et al. ..... 74/6
2,899,829 8/1959 Smith ..... 74/6
4,155,266 5/1979 Bradley ..... 74/6
4,274,292 6/1981 Arnett, Jr. ..... 74/6
4,362,065 12/1982 Baratti ..... 74/6 X
4,553,442 11/1985 Mazzorana ..... 74/7 A
5,016,484 5/1991 Morikane ..... 74/7 A X

FOREIGN PATENT DOCUMENTS 61-53568 4/1986 Japan .

*Primary Examiner*—Allan D. Herrmann
*Assistant Examiner*—David W. Laub
*Attorney, Agent, or Firm*—Skjerven, Morrill, MacPherson, Franklin & Friel

[57] ABSTRACT

A starter system for an internal combustion engine having a casing provided with a mounting circumferential surface adapted to be substantially closely fitted into an associated mounting bore provided in the engine or a transmission housing associated therewith, and a mounting flange extending radially from the casing and provided with a mounting end surface perpendicular to a longitudinal line of the output shaft of the starter system and spaced from the mounting circumferential surface along the longitudinal line. Because of the presence of the distance between the mounting end surface of the mounting flange and the mounting circumferential surface of the starter casing closely fitted into the mounting bore, the reaction force acting on the pinion is prevented from being amplified and transmitted to the mounting surfaces by means of an undesirable lever action.

5 Claims, 4 Drawing Sheets

STARTER SYSTEM FOR AN INTERNAL COMBUSTION ENGINE

TECHNICAL FIELD

The present invention relates to a starter system for an internal combustion engine, and in particular to an engine starter system equipped with an improved structure for mounting the same on an engine.

BACKGROUND OF THE INVENTION

Conventionally, various starters for cranking an internal combustion engine have been known. For instance, as disclosed in Japanese patent laid open publication No. 61-53568, and U.S. Pat. Nos. 4,604,907, 4,561,316, 4,573,364, 4,520,285, 4,510,406, and 4,528,470, a pinion is selectively meshed with a ring gear of the engine to crank the same according to the on-off action of an electromagnetic switch with a DC motor which drives the pinion via a planetary gear reduction unit.

In such a starter, the casing accommodating the pinion is fitted into a mounting bore of a crank case of an engine and is secured therein by fastening threaded bolts passed through a flange portion of the casing in order to ensure the high precision of the meshing between the ring gear and the pinion. Further, a mounting end surface for securing purpose is provided in the flange portion around each of the holes for passing a threaded bolt as a planar surface perpendicular to the axial line of the output shaft, and this mounting end surface is brought into contact with an associated mounting surface of the crank case so that the misalignment of the output shaft at the time of mounting may be avoided.

When the pinion is meshed with the ring gear to crank the engine, the load acting on the pinion is transmitted to the mounting end surface through a certain lever action with the fitted portion or a circumferential mounting surface of the starter casing serving as a fulcrum. According to the above described conventional structure, since the fitting boss portion serving as the mounting circumferential surface extends continuously from the mounting flange portion provided with the mounting end surfaces, a substantial bending moment acts upon the flange and a relatively large load acts upon the mounting end surfaces due to the reaction force acting on the pinion as it cranks the engine. Therefore, in order to ensure a sufficient rigidity of the flange portion, it was necessary to increase the thickness and size of the flange to an undesirable extent.

In assembling such a starter, the casing is supported typically by placing a pair of mounting end surfaces for securing purpose, provided in flanges disposed in diagonally opposing positions on the casing accommodating a pinion, on an assembly jig. Since the mounting end surfaces are provided in diagonally opposing, 180 degree opposed positions around the drive shaft, the axial force applied to the drive shaft when fitting it into the bearing of the casing may be supported by the mounting end surfaces in a stable fashion.

In terms of the freedom in designing the mounting structure between the starter and the engine, it is preferable to arrange holes for passing fastening bolts in mutually asymmetric positions with respect to the drive shaft. However, if the mounting end surfaces defined around such mounting holes are arranged in mutually asymmetric positions with respect to the drive shaft, the force applied to the drive shaft to fit the drive shaft into a bearing provided in the casing while supporting its mounting surfaces with an assembly jig produces a moment, and it impairs the efficiency of the assembly work.

BRIEF SUMMARY OF THE INVENTION

In view of such problems of the prior art, a primary object of the present invention is to provide an engine starter system which can ensure a sufficient rigidity without increasing the size of the mounting end surface.

A second object of the present invention is to provide an engine starter system which can increase the freedom in designing the mounting structure between the starter and the engine without impairing the efficiency of assembly work.

These and other objects of the present invention can be accomplished by providing a starter system for an internal combustion engine, comprising: an electric motor having an output shaft; a power transmission unit including an output shaft carrying a pinion for meshing with a ring gear of an internal combustion engine, an input end of the power transmission unit being coupled to the output shaft of the electric motor; and a casing accommodating the power transmission unit therein, and provided with an opening exposing the pinion gear; the casing being provided with a mounting circumferential surface, for instance, of a cylindrical shape adapted to be substantially closely fitted into an associated bore provided in the engine or a transmission housing associated therewith, and a mounting flange extending radially from the casing and provided with a mounting end surface extending perpendicularly to a longitudinal line of the output shaft of the power transmission unit and spaced from the mounting circumferential surface along the longitudinal line.

Thus, the distance of the step defined between the mounting circumferential surface and the mounting end surface for securing the starter system in the mounting bore of the engine increases the length of the arm of the bending moment between the fulcrum point of the fitted portion and the mounting end surface, and the force acting upon the mounting end surface is reduced, thereby ensuring a sufficient rigidity without increasing the size of the mounting end surface.

Preferably, the mounting flange consists of at least a pair of mutually asymmetrically disposed flange portions extending radially from the casing, each of the flange portions being provided with means for securing the same to an associated mounting surface of the engine or the transmission case, the casing further comprising a counter support surface disposed in a part of the casing diametrically opposed to the mounting flange portions with respect to the output shaft of the power transmission unit.

Thus, by supporting the two mounting end surfaces for securing purpose and the counter support surface serving as a jig seat surface for assembling purpose with associated parts of an assembly jig, it becomes possible to support the case at three points against the force applied to the output shaft or the drive shaft as it is being fitted into the casing, and allows the assembly work to be carried out in a stable fashion while increasing the freedom in designing the mounting structure between the starter and the engine as the mounting end surfaces are not required to be provided in mutually symmetric positions with respect to the output shaft or the drive shaft.

For the convenience of machining, the mounting end surfaces of the mounting flange portions and the counter support surface are disposed on a common plane.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
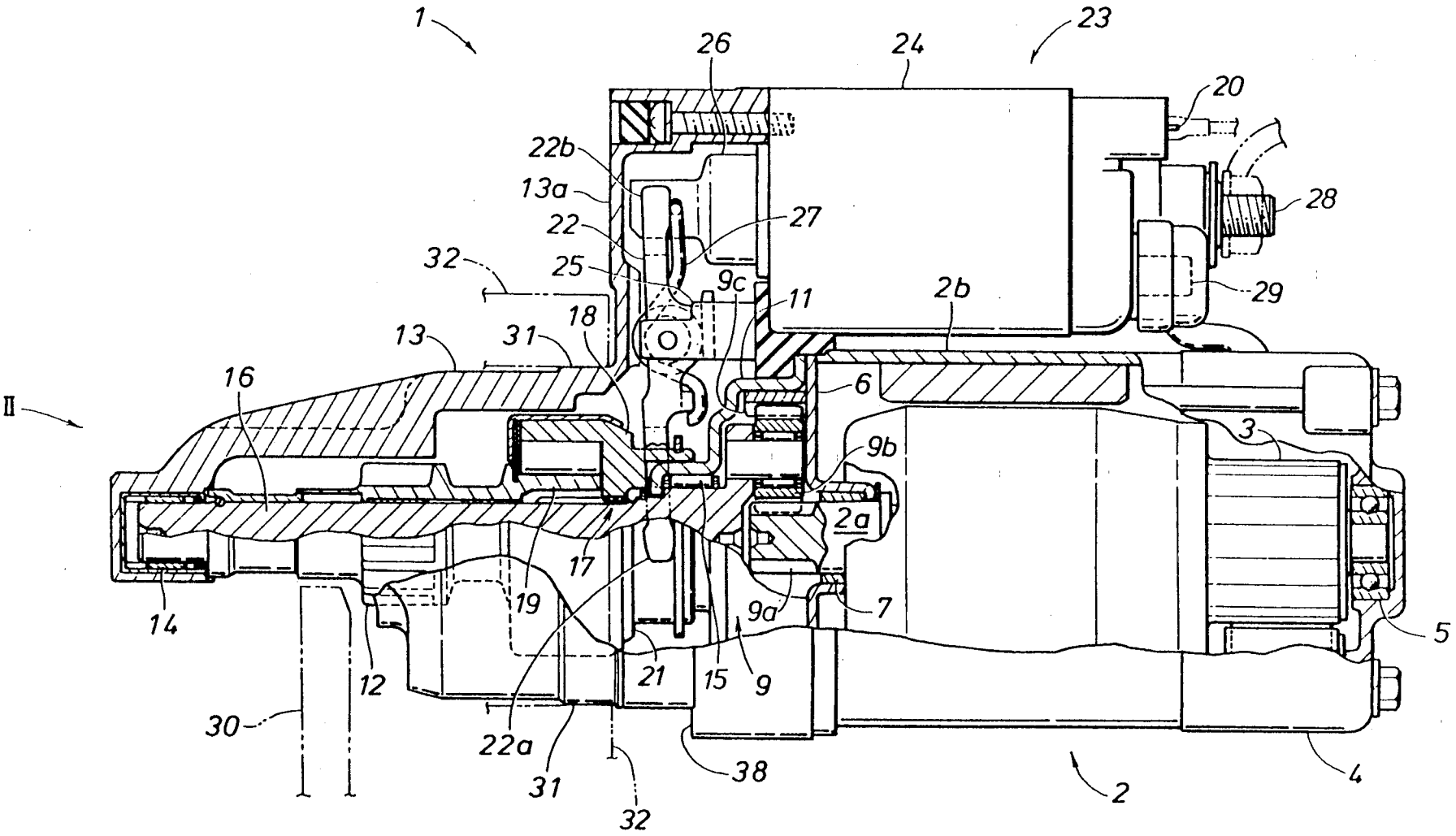
FIG. 1 is a longitudinal sectional view of a preferred embodiment of the starter system according to the present invention.

FIG. 1 generally shows a starter 1 equipped with a reduction gear unit given here as an embodiment of the starter system for an internal combustion engine according to the present invention, and this starter 1 powered by a DC motor 2 produces a rotational power for cranking an engine. As seen in FIG. 1, the right end of the motor shaft 2*a* of the DC motor 2 is rotatably supported by a ball bearing 5 secured to an end cover 4 covering a commutator 3, and the left end of the motor shaft 2*a* is supported by a metal bearing 7 secured to a separator 6 serving as an end plate of the motor 2.

To the left side of the motor shaft 2*a* as seen in FIG. 1 is provided a planetary gear unit 9 serving as a reduction gear unit, and a sun gear 9*a* is mounted on the left free end of the motor shaft 2*a*. Planetary gears 9*b* mesh with the sun gear 9*a*. On the left end of the separator 6 is placed a center bracket 11 defined with a small and a large axial cylindrical portion. The larger cylindrical portion of the center bracket 11 receives an internal gear 9*c*, and the planetary gear unit 9 is received in the space defined between the separator 6 and the center bracket 11.

The separator 6 and the center bracket 11 are fixedly secured between a pinion cover 13 serving as a casing for receiving a pinion 12 which is described hereinafter and a casing 2*b* of the motor 2. The two ends of a drive shaft 16 are supported by a metal bearing 14 fixedly secured to the left free end of the pinion cover 13 as seen in FIG. 1 and a roller bearing 15 fitted in the smaller cylindrical portion of the center bracket 11, coaxially with the motor shaft 2*a*, respectively. The planetary gears 9*b* are pivotally supported by a radial flange portion provided at the right end of the drive shaft 16 as seen in FIG. 1 and received in the center bracket 11.

A clutch outer member 18 of an overrunning clutch consisting of a one-way roller clutch is coupled to the outer circumferential surface of an intermediate part of the drive shaft 16 by way of a spline coupling portion 17 consisting of a helical spline, and a clutch inner member 19 thereof is rotatably and axially slidably fitted on the drive shaft 16. The pinion 12 for driving a ring gear 30 of an internal combustion engine is integrally formed in the axially left end of the clutch inner member 19 as seen in FIG. 1.

The clutch outer member 18 is provided with an annular recess 21 around its circumference, and a bifurcated working end 22*a* of a shift lever 22 engages with this annular recess 21. The shift lever 22 is received in a radially extending peninsular portion 13*a* integrally formed with the pinion cover 13, and a middle part of the shift lever 22 is pivotally supported by a support bracket 25 interposed between a yoke 24 of an electromagnetic switch 23 connected to the peninsular portion 13*a* and the peninsular portion 13*a* itself. A plunger 26 of the electromagnetic switch 23 is engaged by a free end of a spring 27 which is supported by a support bracket 25 at an intermediate part thereof and engaged to a part of the shift lever 22 intermediate between the pivot shaft and the working end portion 22*a*. The free end 22*b* of the shift lever 22 remote from the working end 22*a* is also bifurcated, and is elastically engaged to the end of the spring 27 adjacent the plunger 26. The thus constructed shift means allows the rotative motion of the shift lever 22 according to the movements of the plunger 26 under the attractive force of the electromagnetic switch 23 when it is energized and the restoring force of the return spring in the electromagnetic switch when the latter is not energized.

A battery connecting terminal 28 of the electromagnetic switch 23 is electrically connected to a battery not shown in the drawings, and a switch terminal 20 is electrically connected to an ignition switch not shown in the drawings while a motor connection terminal 29 is electrically connected to the motor 2. When the ignition switch is turned to the starter-on position, the electromagnetic switch 23 is energized, thereby causing the plunger 26 to be attracted thereto and the shift lever 22 to be rotated in clockwise direction in the sense of FIG. 1 by way of the spring 27. As the working end 22*a* of the shift lever 22 pushes out the clutch outer member 18, at the same time, causing it to rotate by means of the spline coupling portion 17 provided in the drive shaft 16, the clutch inner member 19 or the pinion 12 comes into mesh with the ring gear 30 of the engine. The attracted movement of the plunger 26 causes an internal contact set to be closed and thereby the motor 2 to be rotated, and the rotation of the motor 2 is reduced in speed by the planetary gear unit 9 and is transmitted to the pinion 12 which drives the ring gear 30 and cranks the engine.

Since, even when the plunger 26 has been activated but the pinion 12 has failed to mesh with the ring gear 30 by striking the end surface of the gear teeth of the ring gear 30, the plunger 26 can be completely attracted by the electromagnet because of the deflection of the spring 27, and the contact set of the electromagnetic switch 23 is closed in any case and the motor 2 is rotated so that the pinion 12 can continue to be rotated by the motor 2, and can eventually mesh with the ring gear 30 in a reliable manner.

Figure 2:
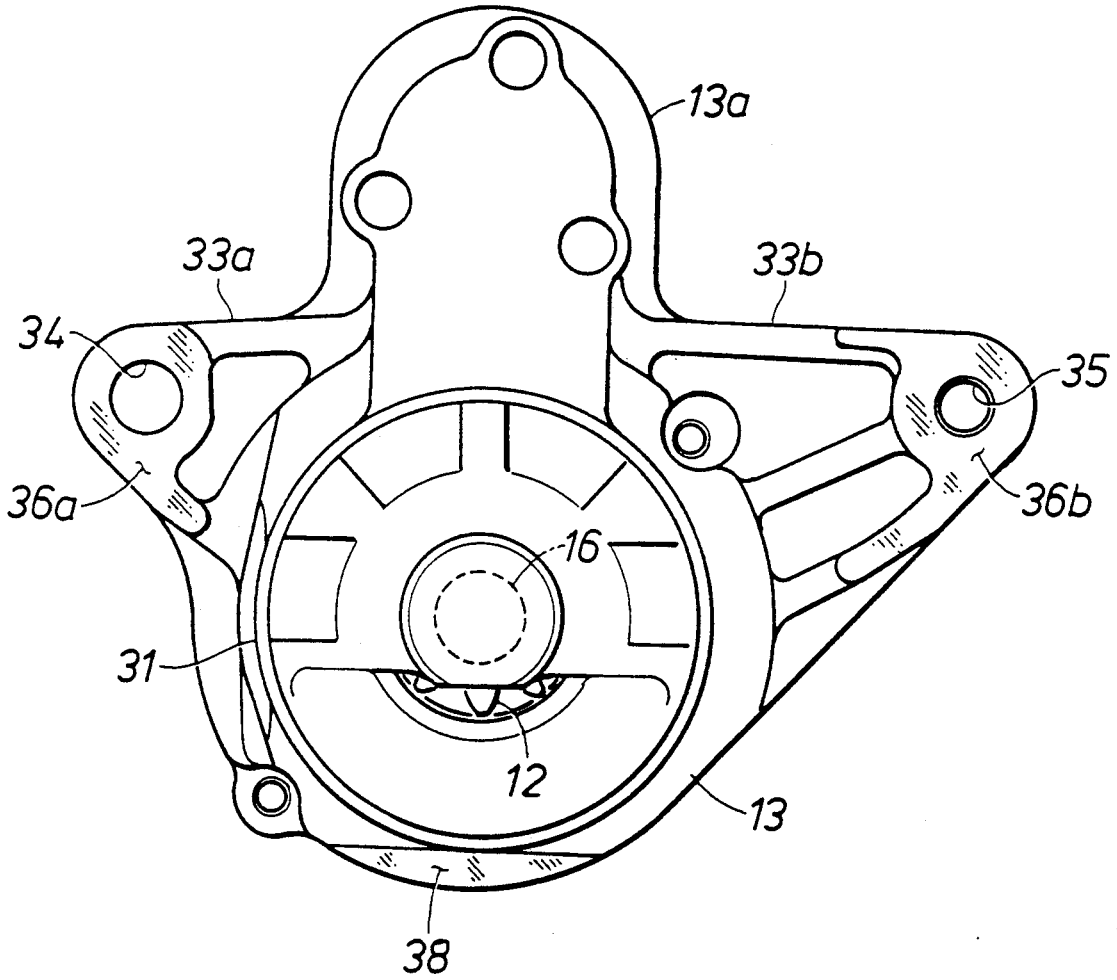
FIG. 2 is a front view of the starter system illustrated in FIG. 1.

A part adjacent the base end of the pinion cover 13 of the thus constructed starter 1 on the right hand side of FIG. 1 is provided with a cylindrical fitting boss portion 31 having an outer circumferential surface serving as a mounting circumferential surface coaxial with the drive shaft 16 for fitting the fitting boss portion 31 into a mounting bore 32*a* provided in the transmission case 32 of the engine, and a pair of mounting flange portions 33*a* and 33*b* projecting radially and outwardly on the base end of the fitting boss portion 31 of the pinion cover 13 as illustrated in FIG. 2. A projecting end portion of one of the mounting flanges 33*a* is provided with a bolt passing hole 34 while the other mounting flange portion 33*b* is provided with a threaded hole 35, each for securing purpose. In this embodiment, the mounting bore 32*a* is provided in the transmission case, but may also be provided in the engine itself.

The pinion cover 13 is provided with a smoothly finished mounting end surface 36*a* or 36*b* for securing purpose around the hole 34 or 35 of each of the mounting flange portions 33*a* and 33*b*, and a jig seat surface 38 for assembly purpose for supporting the pinion cover 13 with an assembly jig as described hereinafter at three points in cooperation with the mounting end surface 36*a* or 36*b* when installing the output shaft 16 into the pinion cover 13. In other words, the jig seat surface 38 serves as a counter support surface. In this embodiment, the three surfaces 36*a*, 36*b* and 38 are defined in a common plane for the convenience of machining, but they may also be placed in mutually different planes if necessary. Also, the mounting circumferential surface defined around the fitting boss portion 31 is preferred to be cylindrical in shape, but may also have other shapes if desired.

Figure 3:
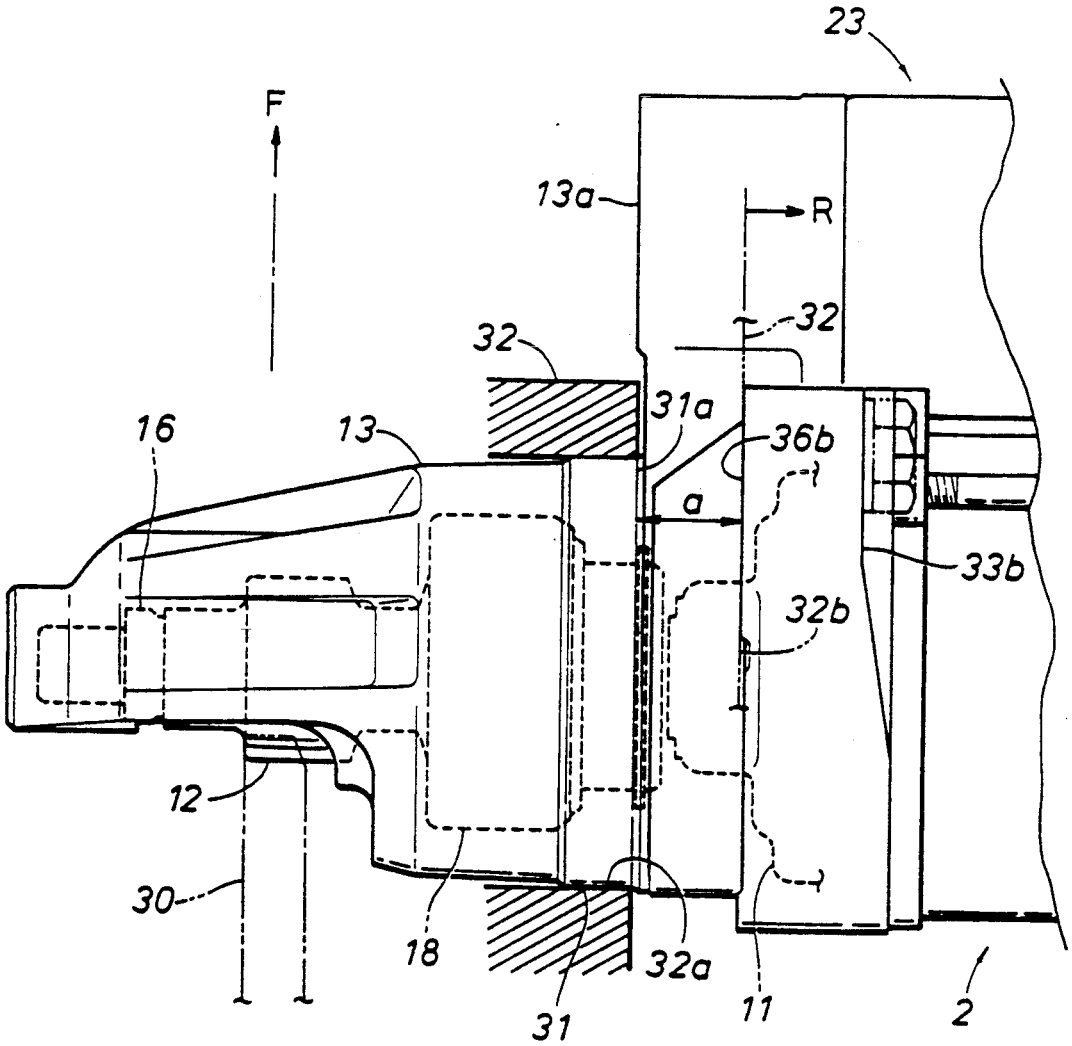
FIG. 3 is an enlarged side view of a part of the starter system illustrated in FIG. 1.

As illustrated in FIG. 3, when the starter 1 is mounted on the transmission case 32, the fitting boss portion 31 is fitted into the mounting bore 32*a* of the transmission case 32, and the mounting end surfaces 36*a* and 36*b* prevent any misalignment of the axial line of the starter 1 during assembly in cooperation with the associated mounting surface 32*b* of the transmission case 32.

In this starter 1, a step of distance a is defined between an end portion 31*a* of the fitting boss portion 31 adjacent the mounting end surfaces 36*a* and 36*b* and the mounting end surfaces 36*a* and 36*b*. Therefore, as shown in FIG. 3, when the pinion 12 is meshed with the ring gear 30 when cranking the engine, and a reaction load F acts upon the pinion 12, a force R acts upon the mounting end surfaces 36*a* and 36*b* due to the moment generated around a fulcrum defined by the fitting boss portion 31. The directions of the load F and the action force R are indicated only for the purpose of illustration.

Since the length of the arm of the moment as measured between the fitting boss portion 31 serving as the fulcrum of the moment and each of the mounting end surfaces 36*a* and 36*b* can be found as the radial distance from the center of the drive shaft 16 and the distance a of the step, the magnitude of the action force R is reduced as opposed to the case where the arm length is given as the radial distance alone. Therefore, the radial distance between the axial center of the drive shaft 16 and each of the mounting end surfaces 36*a* and 36*b* can be relatively reduced, whereby the mounting flange portions 33*a* and 33*b* may be safely reduced in size without requiring the mechanical rigidity and strength of the mounting flange portions 33*a* and 33*b* and the overall size of the starter 1 can be minimized.

In assembling the starter 1 to the transmission case 32, the fitting boss portion 31 is first fitted into the associated mounting bore 32*a* of the transmission case 32, and the starter 1 is fixedly secured by fastening threaded bolts passed through the bolt passing hole 34 and the threaded hole 35. Parts of the mounting flange portions 33*a* and 33*b* facing the mounting surface of the transmission case 32 and surrounding the associated mounting holes 34 and 35 are provided with the mounting end surfaces 36*a* and 36*b*, respectively, as planar surfaces extending perpendicularly to the axial line of the drive shaft 16 for the purpose of controlling the misalignment of the pinion cover 13 as described above. Further, the pinion cover 13 is additionally provided with the jig seat surface 38 for assembling purpose on another side of the drive shaft 16 from that of the mounting end surfaces 36*a* and 36*b* for securing purpose as a planar counter support surface extending on a same plane as the mounting end surfaces 36*a* and 36*b*.

According to this starter 1, the opening angle of the two mounting holes 34 and 35 with respect to the axial center of the drive shaft 16 is determined as approximately 120 degrees, and the two mounting end surfaces 36*a* and 36*b* are arranged at mutually asymmetric positions with respect to the drive shaft 16. Therefore, as opposed to the conventional starter having a pair of mounting threaded holes and mounting end surfaces for securing purpose at mutually 180 degree opposed positions with respect to the drive shaft, the freedom in designing the mounting structure between the starter and the engine is much increased, and by determining the opening angle according to the change in the shape of the side surface of the engine a favorable mounting structure can be ensured for each specific engine design.

Figure 4:
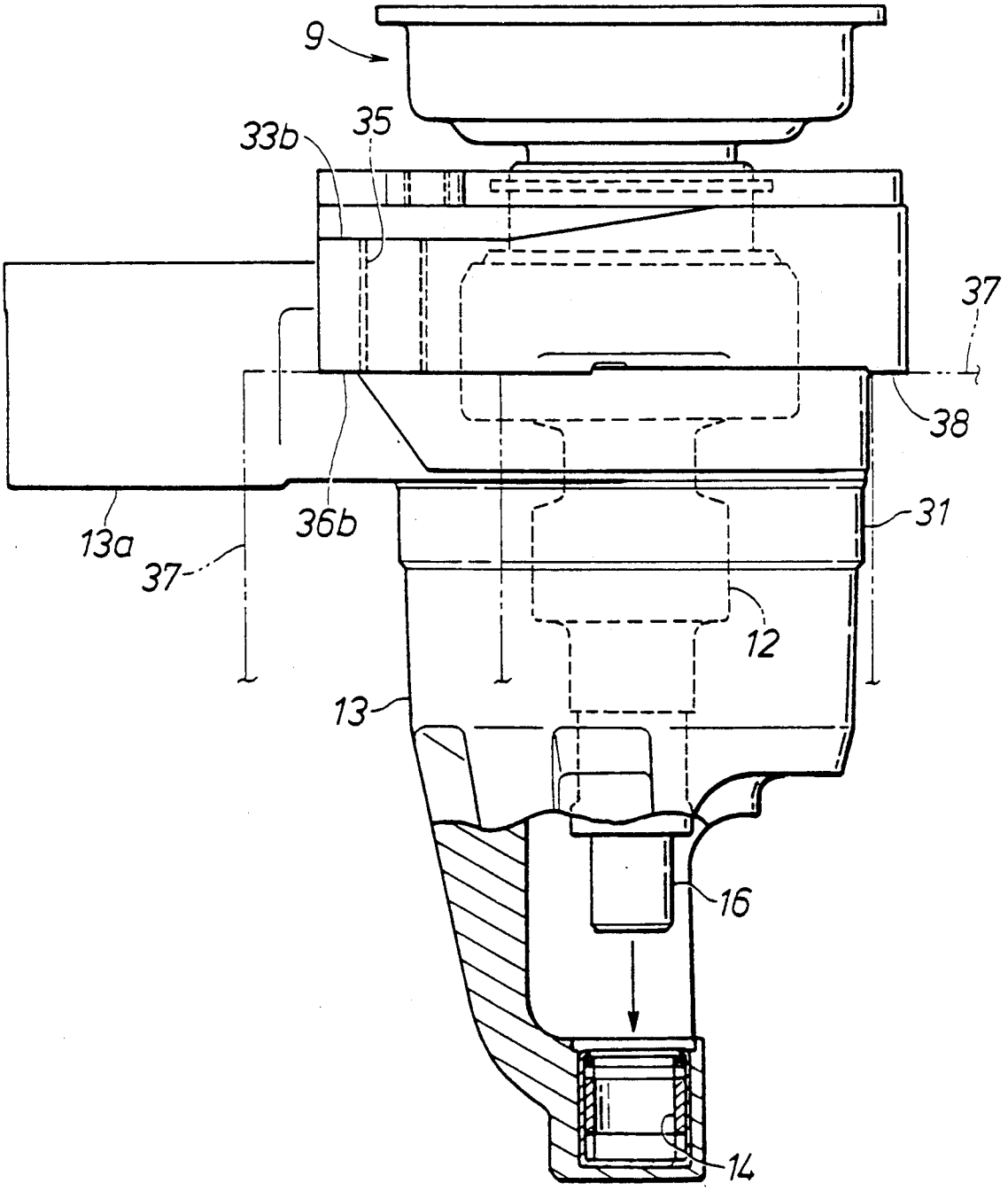
FIG. 4 is a side view illustrating the process of installing the drive shaft in the pinion cover.

Furthermore, in installing the drive shaft 16 into the pinion cover 13 during the process of assembling the starter 1, since the two mounting end surfaces 36*a* and 36*b* as well as the jig seat surface 38 are placed on the assembly jig 37 as illustrated in FIG. 4, and a free end of the drive shaft 16 is fitted into the metal bearing 14 of the pinion cover 13, the pinion cover 13 is supported at three points against the force to force the drive shaft 16 into the metal bearing 14, and a stable assembly process is made possible without tilting the pinion cover 13 as the drive shaft 16 is installed in the pinion cover 13.

Thus, according to the present invention, since an additional length is added to the length of the arm between the fitted portion serving as a fulcrum point and the mounting end surfaces by means of the provision of the step, even when the radial distance between the drive shaft and the mounting end surfaces is reduced, a sufficient rigidity can be ensured to the mounting end surfaces against the action force acting on the mounting end surfaces when cranking the engine, and the overall size of the starter system can be minimized.

Further, since a pair of mounting end surfaces for securing purpose may be provided at mutually asymmetric positions with respect to the drive shaft, and the two mounting end surfaces can be arranged in a favorable fashion for each different engine design, the freedom in designing the mounting structure for the engine starter system is increased, and this can be accomplished without impairing the efficiency of the assembly work by supporting the casing at the three points on the two mounting end surfaces and the jig seat surface in a stable fashion.

Although the present invention has been described in terms of a preferred embodiment thereof, it is obvious to a person skilled in the art that various alterations and modifications are possible without departing from the scope of the present invention which is set forth in the appended claims.

We claim:

1. A starter system for an internal combustion engine, comprising:

an electric motor having an output shaft;

a power transmission unit including an output shaft carrying a pinion for meshing with a ring gear of an internal combustion engine, an input end of said power transmission unit being coupled to said output shaft of said electric motor; and a casing accommodating said power transmission unit therein, and provided with an opening exposing said pinion gear;

said casing being provided with a mounting circumferential surface adapted to be substantially closely fitted into an associated bore provided in said engine or a transmission housing associated therewith, and a mounting flange extending radially from said casing and provided with means for securing said mounting flange onto said engine or said transmission housing and a mounting end surface extending perpendicularly to a longitudinal line of said output shaft of said power transmission unit, said mounting end surface being spaced from a proximal end of said mounting circumferential surface along said longitudinal line.

2. A starter system according to claim 1, wherein said mounting circumferential surface consists of a substantially cylindrical surface.

3. A starter system according to claim 1, wherein said mounting flange consists of at least a pair of mutually asymmetrically disposed flange portions extending radially from said casing, each of said flange portions being provided with means for securing the same to an associated mounting surface of said engine or said transmission case, said casing further comprising a counter support surface disposed in a part of said casing diametrically opposed to said mounting flange portions with respect to said output shaft of said power transmission unit.

4. A starter system according to claim 3, wherein said mounting flange consists of a pair of mounting flange portions.

5. A starter system according to claim 3, wherein mounting end surfaces of said mounting flange portions and said counter support surface are disposed on a common plane.

* * * * *